United States Patent [19]

Brinkman

[11] Patent Number: 5,003,634

[45] Date of Patent: Apr. 2, 1991

[54] BELT TYPE GARMENT WITH FOLDABLE SEAT COVER

[76] Inventor: Robert J. Brinkman, 325 VanVoorhis Ave., Rochester, N.Y. 14617

[21] Appl. No.: 506,226

[22] Filed: Apr. 9, 1990

[51] Int. Cl.[5] ..... A41D 27/12

[52] U.S. Cl. ..... 2/46; 2/48; 2/92; 2/253; 224/224

[58] Field of Search ..... 2/46, 48, 92, 94, 47, 2/253; 224/224, 235, 253

[56] References Cited

U.S. PATENT DOCUMENTS

| | | | |
|---|---|---|---|
| 1,905,235 | 4/1933 | Mandelert | 2/94 |
| 2,437,223 | 3/1948 | Dutrow | 2/94 |
| 2,967,307 | 1/1961 | O'Donnell | 2/253 |
| 3,185,362 | 5/1965 | Wakefield | 2/46 |
| 3,708,799 | 1/1973 | Smithdeal | 2/46 |
| 4,735,423 | 5/1988 | Foss | 2/46 |

FOREIGN PATENT DOCUMENTS

| | | | |
|---|---|---|---|
| 1373791 | 8/1964 | France | 2/94 |

*Primary Examiner*—Werner H. Schroeder
*Assistant Examiner*—Amy B. Vanatta
*Attorney, Agent, or Firm*—Shlesinger, Fitzsimmons & Shlesinger

[57] ABSTRACT

A pair of straps project from opposite ends of a pouch for use in securing the pouch around a person's waist with an elongate opening in the pouch positioned above the person'seat. The opening is releasably closed by two separate (inner and outer) zippers. An elongate panel or sheet of flexible, waterproof material is secured at one end of one edge of the pouch opening to extend downwardly out of one (the outer) zipper into an operative position beneath one's seat, where it can be secured in place by two other straps which fasten around one's legs. At such time the other or inner zipper may be closed to retain personal items, (comb, sunblock lotion, etc.) in the pouch. When not in use the waterproof panel is rolled up and stored in the pouch.

9 Claims, 2 Drawing Sheets

FIG. 3
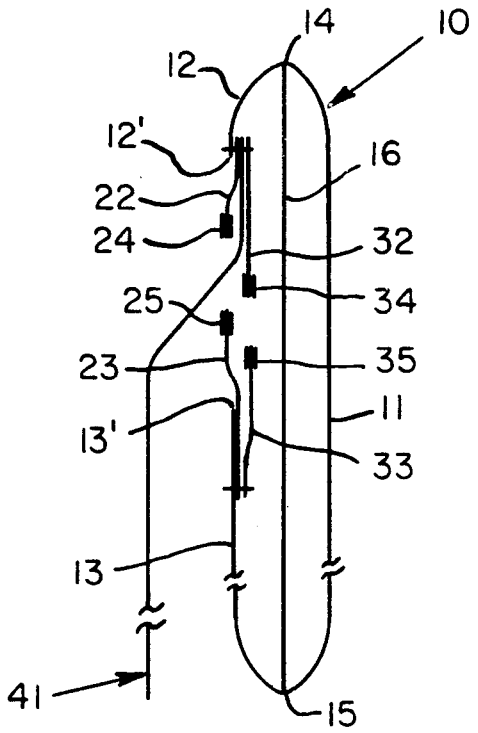
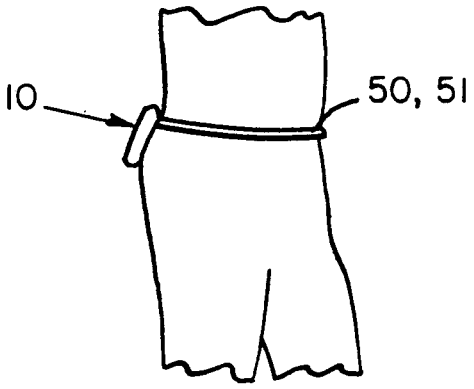
FIG. 4A
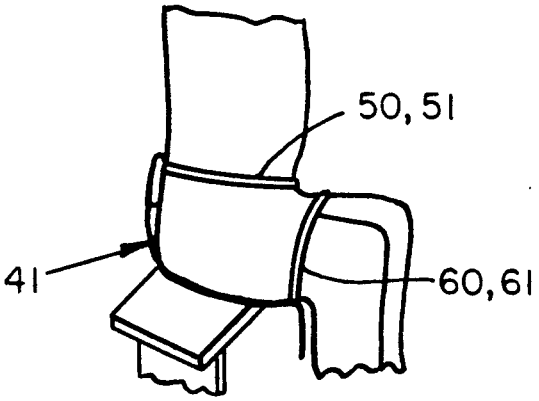
FIG. 4B

BELT TYPE GARMENT WITH FOLDABLE SEAT COVER

BACKGROUND OF THE INVENTION

This invention relates to a belt-like garment containing a foldable seat protector, and more particularly to a novel garment suitable for use out-of-doors in inclement weather or the like. Even more particularly, this invention relates to a belt type garment having thereon a dual zippered pouch containing a foldable, waterproof flat which can be unfolded to cover one's seat, and operable also to function as a container for carrying personal items such as glasses, sun screen, etc.

In recent years people of all ages have become quite health conscious, and have participated more extensively in outdoor sports, such as for example downhill skiing, cross country skiing, hiking , and the like. Most of these activities require the participant to be out-of-doors at times when the weather is rather inclement, or at least at times when they are exposed to snow and/or rain. Particularly in cooler climates, exposure to such elements can often result in illness, to say nothing of discomfort, unless the participants are suitably dressed for the outdoor event. Skiers, for example, frequently are required to sit upon extremely cold or wet surfaces, such as chair lifts, outdoor benches, or the ground itself. In any such case the body temperature tends to melt or otherwise cause moisture to be absorbed into one's clothing, therefore resulting in extreme discomfort to the person wearing the damp clothing. Moreover if such moisture penetrates the pockets of a garment, the contents of the pockets can be damaged or destroyed.

Heretofore efforts have been made to provide seat protective garments for outdoor sportsmen and the like. U.S. Pat. Nos. 3,708,799, 4,689,829, 4,459,703 and 3,185,362, for example disclose various forms of seat protective garments or items. Most such garments, however, do not include satisfactory means for securing the protective portion of the garment in a folded, belt-like mode, when not in use. Further than this, none of these prior art garments has provided any satisfactory means for securing personal items in a pouch that is incorporated in the garment in the manner disclosed hereinafter.

Accordingly, it is an object of this invention to provide a novel belt-like garment containing a foldable seat protector or cover, and combined with an integral pouch for carrying personal items and the like.

Still another object of this invention is to provide a novel belt type garment which includes a foldable seat protective element that can be collapsibly carried in a dual zippered pouch that is formed in the garment.

Other objects of the invention will be apparent hereinafter from the specification and from the recital of the appended claims, particularly when read in conjunction with the accompanying drawings.

SUMMARY OF THE INVENTION

An elongate, nearly envelope-shaped pouch is formed by folding marginal end sections of a rectangular plastic or fabric panel into overlapping relation with one face of a center section of the panel, and then securing together the registering side edges of the center section and overlapping end sections, thus producing a pouch having an opening formed between the confronting edges of the end sections of the panel. Each of these confronting edges has attached thereto two parallel sets of zipper teeth; and the two sets on one edge are adapted to be releasably and selectively secured by conventional zipper slides to the two sets of teeth on the other edge, thus forming two separate zippers (inner and outer) for closing the opening in the pouch.

Attached along one edge thereof between the two sets of zipper teeth at one side of the opening in the pouch is an elongate, rectangularly shaped sheet of waterproof plastic or fabric, which extends through the open, inner zipper and into the pouch in a folded or collapsed position, when not in use, and which can be unfolded to extend out of the pouch through the open, outer zipper, when in use. A pair of straps which project from opposite ends of the pouch have thereon VELCRO-type pads or buckles for securing the pouch around one's waist at the back thereof, and with the zippered opening facing outwardly. When the waterproof sheet is unfolded out of the pouch, another set of straps which extend from opposite sides thereof can be tied or secured around the wearer's legs to retain the waterproof sheet beneath his or her seat. At such time the inner zipper may be closed to retain personal items in the pouch.

THE DRAWINGS

Figure 2:
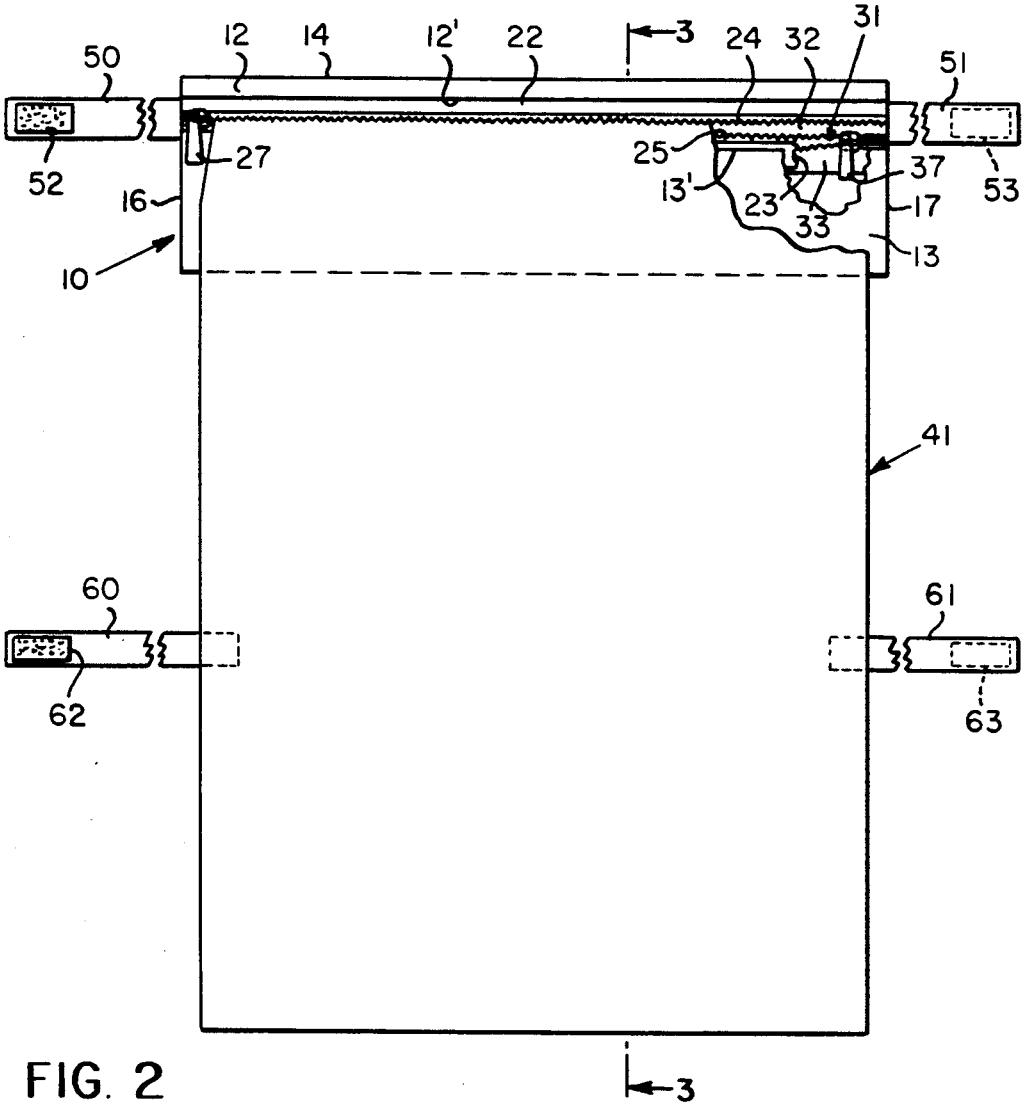
FIG. 2 is a view generally similar to FIG. 1, but showing the seat protective element in its unfolded or extended position, and with portions of the protective element and first pouch cut away in part.

FIG. 3 is an enlarged, fragmentary, schematic cross sectional view of this garment as seen when taken along the line 3–3 in FIG. 2; and FIGS. 4A and 4B are schematic illustrations illustrating, respectively, the garment as it appears when it is worn as a belt with the seat protective flap in its folded or unused position, and as it appears when its protective flap has been unfolded and placed in an operative position.

DETAILED DESCRIPTION OF THE PREFERRED EMBODIMENTS

Referring now to the drawings by numerals of reference, and first to FIGS. 1 to 3, 10 denotes generally a pouch made from an elongate fabric or plastic panel having a mid section 11 (FIG. 3), which forms the back of the pouch 10, and marginal end portions or sections 12 and 13, which are folded inwardly toward each other, and in overlapping relation to the mid section 11 of the panel along spaced, parallel seams 14 and 15, respectively. Overlapping side edges of the back section 14 and the overlapping front sections 12 and 13 of the pouch 10 are secured together along the spaced, parallel seams 16 and 17 in any conventional manner, such as for example by stitching, or the like, thereby to close opposite ends of the pouch 10.

Figure 1:
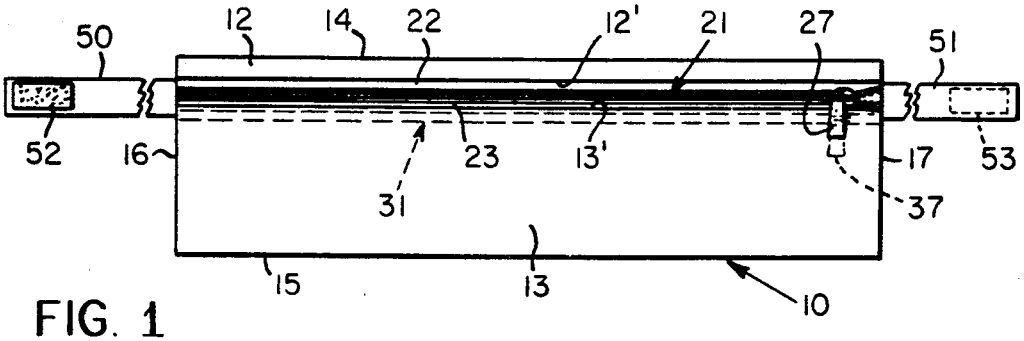
FIG. 1 is a fragmentary front elevational view of an novel belt type garment having an associated seat protective element or flat enclosed in a first pouch which forms part of the garment.

As shown more clearly in FIGS. 1 and 3, the front sections 12 and 13 of the pouch 10 have formed thereon spaced, confronting terminal edges 12' and 13', respectively, which extend longitudinally, and generally parallel to each other, between the end seams 16 and 17 of pouch 10. Edges 12' and 13' of the panel sections 12 and 13 are adapted to be releasably secured together by an outer zipper, which is denoted generally at 21 in FIG. 1, or by an inner zipper denoted generally at 31 in FIG. 2. The outer zipper 21 comprises two elongate fabric strips 22 and 23 having outer edges which are stitched to edges 12' and 13', respectively, of the pouch 10, and confronting, inner edges which have formed thereon cooperating sets 24 and 25, respectively, of conventional zipper teeth. The sets of teeth 24 and 25 of zipper 21 are disposed to be releasably secured together or separated from one another in the usual manner by manipulation of a conventional slide operating tab 27 (FIGS. 1 and 2).

The inner zipper 31 likewise comprises a pair of elongate fabric strips 32 and 33 (FIG. 3) having outer edges stitched to edges 12' and 13' of the pouch 10 in overlapping relation to the strips 22 and 23, respectively, of the outer zipper 21. The two remaining or confronting edges of the strips 32 and 33 have secured thereon conventional sets 34 and 35, respectively, of zipper teeth, which also are disposed to be releasably connected to or separated from each other by manipulation of a conventional slide operating tab which is denoted at 37 in FIGS. 1 and 2.

Also stitched along one edge thereof (the upper edge as shown in FIG. 3) to the edge 12' of pouch 10 between fabric strips 22 and 32 is a large, rectangular waterproof sheet 41 of fabric or plastic which, as noted hereinafter is designed to function as a seat protector or cover for the person wearing pouch 10. This cover or flap 41 is disposed to be foldable or rollable into a collapsed mode in which the bulk thereof can be inserted into pouch 10 through the open, inner zipper 31, and then can be enclosed or secured within pouch 10 simply by closing zipper 21.

In order to secure the pouch 10 as a garment around the waist of an individual, two straps 50 and 51 are secured at their inner ends in any conventional manner to the back section 11 of the pouch 10 adjacent opposite ends thereof, and project at their opposite ends beyond opposite ends of pouch 10 for distances sufficient to permit the straps 50, 51 to be wrapped around the waist of the person to whom the pouch 10 is to be attached. At their outer ends the strap sections 50 and 51 have secured thereon, if desired, cooperating VELCRO pads 52 and 53, respectively, which can be employed for releasably attaching together the outer ends of the straps around the waist of the person that is wearing the pouch 10.

Also fastened adjacent their inner ends to the seat cover or flap 41 intermediate the ends thereof, and projecting beyond opposite sides of flap 41 are two additional, flexible straps 60 and 61. As in the case of straps 50 and 51, the straps 60 and 61 may have attached to the outer ends thereof cooperating VELCRO pads 62 and 63, which can be utilized to retain the waterproof flap 41 beneath the seat of the person wearing pouch 10, when the flap or cover 41 is placed in use as noted hereinafter.

Referring now to FIGS. 4A and 4B, FIG. 4A illustrates schematically one manner in which the straps 50, 51 can be releasably attached together in order to secure the garment around the waist of a person, so that the pouch 10 will be located at one's back adjacent his or her hips. As shown in this FIG. the seat cover or flap 41 has been rolled or folded up, together with its straps 60 and 61, into a small package which fits neatly in pouch 10. Also at this time, if desired, personal items, such as one's glasses, sun block, comb and other such items can be stored in the pouch 10 along with the collapsed seat cover 41.

When it is desired to utilize the protective cover section or flap 41, the outer zipper 21 is opened and the flap 41 is unfolded or rolled downwardly beneath one's seat, as shown for example in FIG. 4B. Flap 41 can then be retained in this operative position by virtue of the straps 60 and 61, which can be passed around one's legs and secured together by the VELCRO pads 62, 63. When it is no longer needed, of course, its straps 60 and 61 can be disconnected and the cover element 41 can again be rolled up or folded back into the pouch 10.

From the foregoing it will be apparent that the present invention provides a relatively simple and inexpensive garment which performs the dual function of preventing moisture from penetrating one's clothing, particularly in the seat area, and also providing secure means for carrying personal items in a waist-mounted pouch. By using two separate zippers 21 and 31 for closing the opening in pouch 10, it is possible securely to retain personal items in pouch 10 even when the outer zipper 21 necessarily is opened to permit the cover 41 to be placed in use.

While in the preferred embodiment of this invention it has been suggested that VELCRO pads be employed for securing together the straps 50, 51 and 60, 61, it will be readily apparent that in lieu thereof, conventional belt buckle means could be employed, or the straps could be releasably tied together in any conventional manner. Also, of course, the strap sections 50, 51 and 60, 61 could be made from elasticized material, if desired, and the cover section 41, simply by way of example, could have a rectangular configuration of approximately 18" square. In such case the overall length of the strap sections, such as sections 50, 51 could be in the vicinity of 36". These dimensions, of course, are merely by way of example.

Moreover, while it has been suggested that the cover section 41 be stored in the same section of the pouch as one's personal items, it will be noted that the space between the two zippers 21 and 31 in fact forms a second pouch in pouch 10, or a pouch within a pouch. Simply by using larger or wider fabric strips 22, 23 and 32, 33 this pouch could be enlarged to any desired size without departing from this invention.

While this invention has been illustrated and described in detail in connection with only certain embodiments thereof, it will be apparent that this application is intended to cover any such modifications as may be fall within the scope of one skilled in the art, or the appended claims.

I claim:

1. A belt type garment, comprising means defining an elongate, flexible pouch having thereon a pair of confronting, longitudinally extending edges defining therebetween an elongate opening in one side of said pouch, zipper means on said confronting edges of said pouch for releasably closing said opening, a first set of flexible strap elements projecting from opposite ends, respectively, of said pouch and disposed to be releasably secured around a person's waist to support said pouch above and in registry with the person's seat, a flexible, waterproof panel secured at one end thereof to one of said confronting edges of said pouch for movement between an operative position in which said panel extends at its opposite end out of said opening and downwardly behind said person's seat, when the pouch is mounted thereabove, and a collapsed position in which said panel is rolled up and positioned within the interior of said pouch, and a second set of flexible strap elements projecting from opposite sides, respectively, of said panel and disposed to be releasably secured around a person's legs, when said panel is in its operative position, thereby releasably to retain said panel in said operative position.

2. A belt type garment as defined in claim 1, including a second opening in said one side of said pouch, and wherein said zipper means comprises a pair of zippers each of which is operable independently of the other for selectively closing one of said openings.

3. A belt type garment as defined in claim 2, wherein one of said pair of zippers is positioned inwardly of said pouch relative to the other zipper of said pair whereby when said other zipper is closed said one zipper is inaccessible.

4. A belt type garment as defined in claim 3, including means defining a closed chamber in said pouch between said pair of zippers when each of said zippers is closed.

5. A belt type garment as defined in claim 1, wherein said zipper means comprises an outer zipper including two rows of teeth, one of said rows of teeth being secured to and extending longitudinally of said one edge of said pouch, and the other of said rows of teeth being secured to and extending longitudinally of the other edge of said pouch, and means for selectively connecting the teeth of said one row to the teeth of said other row thereof, thereby selectively to close said outer zipper and said opening in said pouch, said one end of said panel being secured to said one edge of said pouch inwardly of said one row of teeth, whereby in its operative position said opposite end of said panel extends outwardly of the pouch and between said rows of teeth, and in its collapsed position the rolled up panel is positioned in said pouch inwardly of said outer zipper whereby the latter may be closed.

6. A belt type garment as defined in claim 5, wherein said zipper means further comprises an inner zipper having two further rows of teeth, one of said further rows being secured to said one edge of said pouch inwardly of said one end of said panel and said one row of teeth of said outer zipper, and the other of said further rows being secured to said other edge of said pouch inwardly of said other row of teeth of said outer zipper, and means for selectively connecting together the teeth of said two further rows thereof, thereby selectively to close said inner zipper and said opening in said pouch independently of said outer zipper.

7. A belt type garment as defined in claim 6, including means forming a closed chamber in said pouch between said inner and outer zippers, when said zippers are closed.

8. A belt type garment, comprising means defining an elongate, flexible pouch having thereon a pair of confronting, longitudinally extending edges defining therebetween an elongate opening in one side of said pouch, elongate closure means on said confronting edges of said pouch for releasably closing said opening, a first set of flexible strap elements projecting from opposite ends, respectively, of said pouch and disposed to be releasably secured around a person's waist to support said pouch above and in registry with the person's seat, a flexible, waterproof panel secured at one end thereof to one of said confronting edges of said pouch for movement between an operative position in which said panel extends at its opposite end out of said opening and downwardly behind said person's seat, when the pouch is mounted thereabove, and a collapsed position in which said panel is rolled up and positioned within the interior of said pouch, and a second set of flexible strap elements projecting from opposite sides, respectively, of said panel and disposed to be releasably secured around a person's legs, when said panel is in its operative position, thereby releasably to retain said panel in said operative position, said closure means comprising two pairs of elongate fabric strips, one of said pair of strips being secured to and extending logitudinally of said one edge of said pouch, and the other pair of said strips being secured to and extending longitudinally of the other edge of said pouch, and means for selectively and releasably connecting the fabric strips of said one pair thereof to the strips of the other pair thereof, thereby selectively to close said opening in said pouch.

9. A belt type garment as defined in claim 8, wherein said one end of said panel is secured between said one pair of fabric strips, whereby when said panel is in its operative position said opposite end thereof extends between only one strip of each of said pairs thereof, whereby the other strips of pairs thereof may be releasably connected together by said connecting means to close said opening in said pouch.

* * * * *